US012622477B2

(12) United States Patent
Hirano

(10) Patent No.: US 12,622,477 B2
(45) Date of Patent: May 12, 2026

(54) HAIR EXTENSION

(71) Applicant: Ryuki Hirano, Nagoya (JP)

(72) Inventor: Ryuki Hirano, Nagoya (JP)

( * ) Notice: Subject to any disclaimer, the term of this patent is extended or adjusted under 35 U.S.C. 154(b) by 342 days.

(21) Appl. No.: 17/793,028

(22) PCT Filed: Jul. 22, 2020

(86) PCT No.: PCT/JP2020/028561
§ 371 (c)(1),
(2) Date: Jul. 14, 2022

(87) PCT Pub. No.: WO2021/149282
PCT Pub. Date: Jul. 29, 2021

(65) Prior Publication Data

US 2023/0040318 A1 Feb. 9, 2023

(30) Foreign Application Priority Data

Jan. 21, 2020 (JP) ..... 2020-007552

(51) Int. Cl.
*A41G 5/00* (2006.01)

(52) U.S. Cl.
CPC ..... *A41G 5/008* (2013.01)

(58) Field of Classification Search
CPC .... A41G 5/004; A41G 5/0046; A41G 5/0053; A41G 5/008
(Continued)

(56) References Cited

U.S. PATENT DOCUMENTS 5,575,298 A * 11/1996 Hinton ..... A41G 5/004 132/71.1
10,034,507 B2 * 7/2018 Thomas ..... A41G 5/0046
(Continued)

FOREIGN PATENT DOCUMENTS

JP 2008-202199 A 9/2008
JP 3198852 U 7/2015
(Continued)

OTHER PUBLICATIONS

Gunter Alex, WO-2019155079 English Translation, Description. Espacenet Sep. 24, 2024 https://translationportal.epo.org/emtp/translate/?ACTION=description-retrieval&COUNTRY=WO&ENGINE=google&FORMAT=docdb&KIND=A1&LOCALE=en_EP&NUMBER=2019155079&SRCLANG=de&TRGLANG=en (Year: 2024).*
(Continued)

*Primary Examiner* — Nicholas D Lucchesi
(74) *Attorney, Agent, or Firm* — Muncy, Geissler, Olds & Lowe, P.C.

(57) ABSTRACT

Problem
Provided is a practical hair extension configured to be very easily attached to head hair (natural hair) and attachment of which on the head hair is less likely to be noticed by other people.
Solution
A hair extension 1 includes a hair bundle 2, a double-sided adhesive tape 3, and a release paper 4. The hair bundle 2 has a base end including a first hair layer $L_1$ formed by laterally aligning a plurality of hairs $h_1$, $h_1$ . . . such that base end edges of the plurality of hairs are linearly arranged and bonding vicinities of the base ends of the hairs $h_1$, $h_1$ with an adhesive so as to have a constant adhesive width, and a second hair layer $L_2$ formed by laminating a plurality of hairs $h_2$, $h_2$ . . . to be laterally aligned on an upper side of the first hair layer $L_1$ such that base end edges of the plurality of hairs are linearly arranged and bonding vicinities of the base ends of the hairs $h_2$, $h_2$ . . . with an adhesive so as to have an adhesive width narrower than the adhesive width of the first hair layer $L_1$. Furthermore, the double-sided adhesive tape 3 is stuck to the first hair layer $L_1$.

10 Claims, 7 Drawing Sheets

(58) Field of Classification Search
USPC ..... 132/53, 201
See application file for complete search history.

(56) References Cited

U.S. PATENT DOCUMENTS

D885,674 S * 5/2020 Sun ..... D28/93
2001/0037813 A1* 11/2001 Ra ..... A41G 5/008 132/53
2009/0032041 A1* 2/2009 Ott ..... A41G 5/008 132/53
2010/0236563 A1* 9/2010 Kimura ..... A41G 3/00 132/54
2011/0094530 A1* 4/2011 Sedillo-Beadell ..... A41G 5/008 132/201
2012/0118315 A1* 5/2012 Goff ..... B41J 3/407 132/201
2013/0167858 A1* 7/2013 Lee ..... A41G 5/0066 132/54
2013/0180540 A1* 7/2013 Di Biase ..... A41G 5/004 132/54
2017/0065014 A1* 3/2017 Kenna ..... A41G 5/0073
2017/0164674 A1* 6/2017 Rubenstein ..... A41G 5/0046
2017/0265550 A1* 9/2017 Han ..... A41G 5/0073
2019/0125021 A1* 5/2019 Doubt ..... A41G 5/0086
2019/0281912 A1* 9/2019 Mayer ..... A41G 5/0073

FOREIGN PATENT DOCUMENTS

JP 6650160 B1 * 2/2020
WO WO-2016209033 A1 * 12/2016 ..... A41G 5/0046
WO WO-2019155079 A1 * 8/2019 ..... A41G 5/0046

OTHER PUBLICATIONS

Naoki Takubo, JP 6650160 English Translation, Description. (Year: 2024).*
Ryu, WO-2016209033 English Translation, Apr. 3, 2025, Description (Year: 2025).*

* cited by examiner

HAIR EXTENSION

TECHNICAL FIELD

The present invention relates to a hair extension (hairpiece) attached to natural hair for a purpose such as giving a voluminous look to the head hair.

BACKGROUND ART

As a conventional hair extension, there has been known a hair extension in which a metal tube is disposed to a base end of a hair bundle to be attached, and the hair extension is attached to natural hair by crushing the tube in a state where the natural hair is internally inserted through the metal tube. There has been developed a hair extension in which an outside of a cylindrical body including a hair bundle immersed in an adhesive is coated with a heat shrinkable tube, and the heat shrinkable tube is heated by an iron and the like in a state where natural hair is internally inserted through the cylindrical body, thereby attaching the hair extension to the natural hair with the shrunk tube and the melted adhesive (Patent Document 1).

Furthermore, recently, for easier attaching to the head hair in a shorter time, there has been developed a hair extension of a type of being adhered to natural hair using a double-sided adhesive tape (that is, hair is adhered to one surface of the double-sided adhesive tape, and the other surface of the double-sided adhesive tape is adhered to the natural hair) (Patent Document 2).

Patent Document 1: Japanese Unexamined Patent Application Publication No. 2008-202199

Patent Document 2: Japanese Registered Utility Model No. 3198852

DISCLOSURE OF THE INVENTION

Problems to be Solved by the Invention

However, while the hair extension of the type of being adhered to the natural hair using the double-sided adhesive tape as Patent Document 2 can be very easily attached to head hair (natural hair), there is a problem in that wearing it on the head hair is instantly noticed by other people because the double-sided adhesive tape is seen from a gap in the adhered hair. There is also a problem in that the natural hair is bonded to the double-sided adhesive tape from the gap in the adhered hair.

The present invention has an object to solve the above-described problems of the conventional hair extensions and provide a practical hair extension that can be very easily attached to head hair (natural hair) and attachment of which on the head hair is less likely to be noticed by other people.

Solutions to the Problems

In the present invention, the invention described in claim 1 is a hair extension that includes a hair bundle having a base end and a double-sided adhesive tape stuck to the base end for attaching the hair bundle to natural hairs. The base end of the hair bundle includes a first hair layer formed by laterally aligning a plurality of hairs such that base end edges of the plurality of hairs are linearly arranged and bonding vicinities of the base ends of the hairs with an adhesive so as to have a constant adhesive width, and a second hair layer formed by laminating a plurality of hairs to be laterally aligned on an upper side of the first hair layer such that base end edges of the plurality of hairs are linearly arranged and bonding vicinities of the base ends of the hairs with an adhesive so as to have an adhesive width narrower than the adhesive width of the first hair layer. The double-sided adhesive tape is stuck to the first hair layer.

According to the invention described in claim 2, in the invention described in claim 1, the first hair layer and the second hair layer are formed to have constant thicknesses (or approximately constant thicknesses).

According to the invention described in claim 3, in the invention described in claim 1 or claim 2, the thicknesses of the first hair layer and the second hair layer are each adjusted to 0.05 mm or more and 0.4 mm or less, and the thickness of the second hair layer is equal to or less than the thickness of the first hair layer.

According to the invention described in claim 4, in the invention described in any one of claims 1 to 3, slits are provided in parallel at predetermined intervals at an outer end edge of the double-sided adhesive tape.

Effects of the Invention

The hair extension according to claim 1 can be very easily attached to the head hair in a very short period using the double-sided adhesive tape (adhering means). Furthermore, since the base end of the hair bundle to which the double-sided adhesive tape is stuck is formed by laminating the second hair layer formed by bonding a plurality of hairs with a narrow width (narrow width along a longitudinal direction of the hair) on the first hair layer formed by bonding a plurality of hairs with a wide width (wide width along the longitudinal direction of the hair) (that is, since the first hair layer is covered with the second hair layer in which the bonding portion is less likely to be noticeable), the double-sided adhesive tape is less likely to be seen from the outside of the base end of the hair bundle, and therefore, its attachment is less likely to be noticed by other people. Additionally, a case where the natural hair is bonded to the double-sided adhesive tape from the gap in the adhered hair as the conventional hair extension is less likely to occur.

In the hair extension according to claim 2, since the first hair layer and the second hair layer are formed to have the constant thicknesses (including approximately constant thicknesses of about ±0.1 mm), the double-sided adhesive tape is extremely less likely to be seen from the outside of the base end of the hair bundle. Additionally, since an adhesive strength between the first hair layer and the second hair layer is high, a case where the bundled hairs fall out is less likely to occur.

In the hair extension according to claim 3, since the thicknesses of the first hair layer and the second hair layer are each adjusted to the predetermined thicknesses, and the thickness of the second hair layer is equal to or less than the thickness of the first hair layer, the double-sided adhesive tape is extremely less likely to be seen from the outside of the base end of the hair bundle, and additionally, a case where the hairs constituting the second hair layer fall out is less likely to occur even when the hair extension is used for a long period of time.

In the hair extension according to claim 4, since slits are provided in parallel at predetermined intervals at an outer end edge of the double-sided adhesive tape, the hair extension can be strongly bonded (adhered) in a state where the double-sided adhesive tape is folded at the portions of the slits and the head hair (natural hair) is sandwiched by the double-sided adhesive tape.

DESCRIPTION OF PREFERRED EMBODIMENTS

Figure 1:
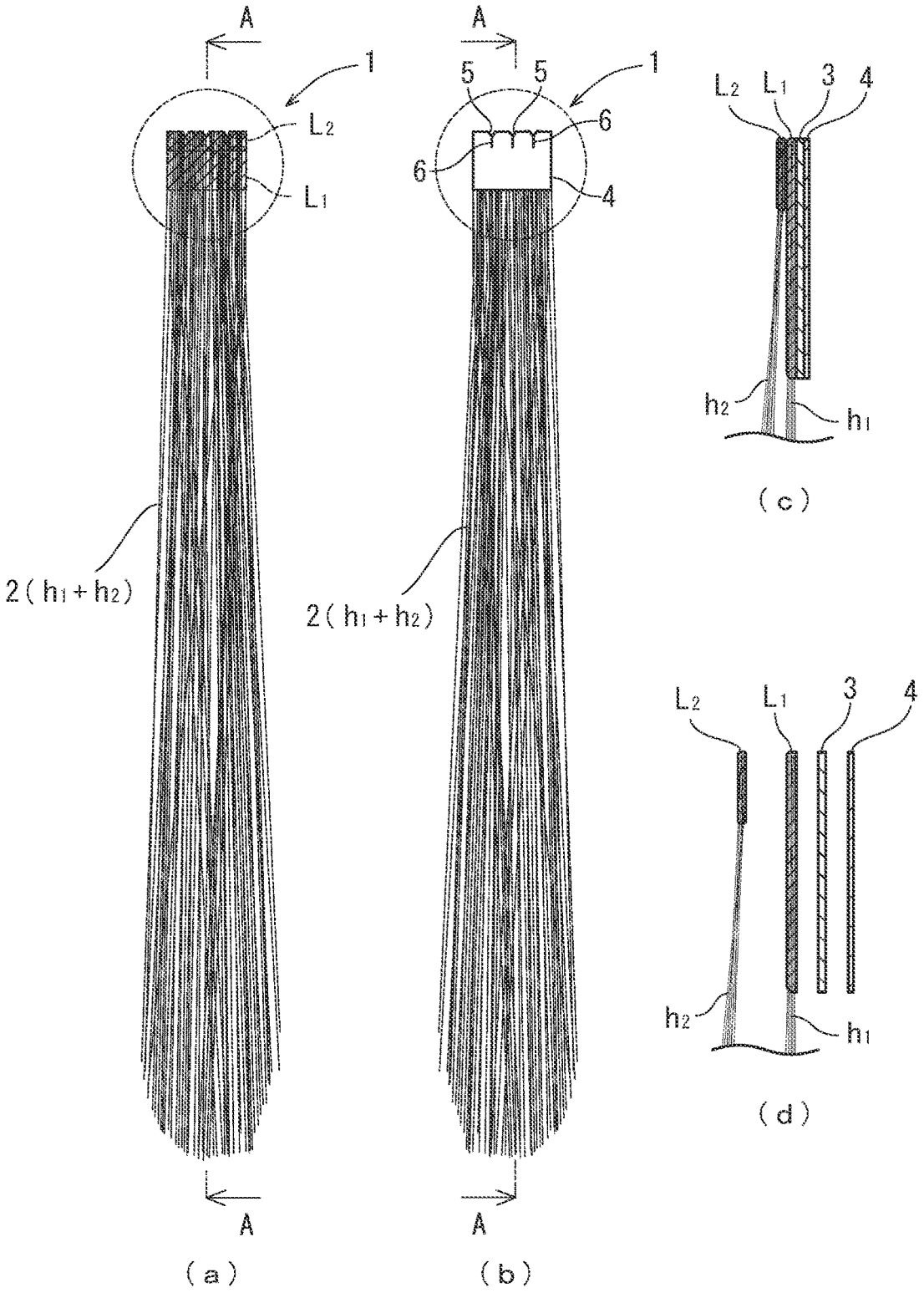
FIG. 1 is an explanatory drawing illustrating a hair extension (a is a front view, b is a back view, c is a right side view, and d is a right side view in an exploded state).
Figure 2:
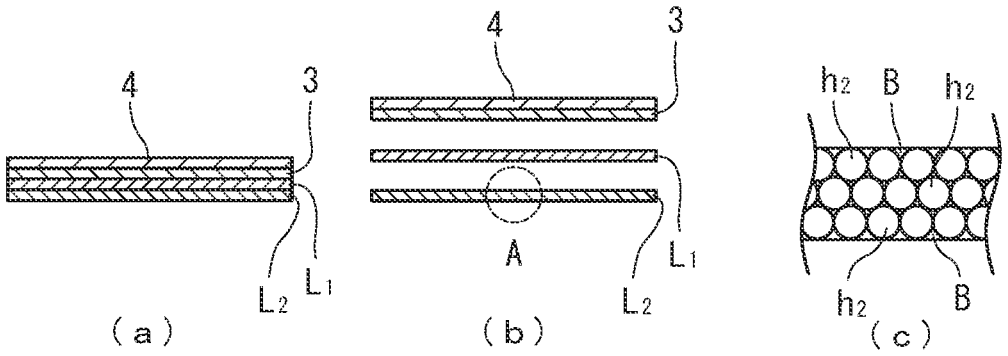
FIG. 2 is an explanatory drawing illustrating the hair extension (a is a plan view, b is a plan view in an exploded state, and c is a conceptual diagram illustrating an enlarged part A in b).

A hair extension according to the present invention includes a hair bundle having a base end in which a first hair layer formed by bonding vicinities of base ends of a plurality of laterally aligned hairs (first hairs) with an adhesive in a constant width (width along a longitudinal direction of the hair) and a second hair layer formed by bonding vicinities of base ends of a plurality of laterally aligned hairs (second hairs) with an adhesive in a width narrower (shorter) than the adhesive width of the first hair layer are laminated, and a double-sided adhesive tape (adhering means) is stuck (adhered) to a back surface (inner surface) of the first hair layer. That is, in the hair extension according to the present invention, by laminating the second hair layer having the adhesive width narrower (shorter) than that of the first hair layer on an upper side of the first hair layer (that is, by laminating the second hair layer in which the bonding portion is less likely to be noticeable), the first hair layer is made less likely to be seen from outside, thereby making its attachment extremely less likely to be noticed.

While the adhesive width of the first hair layer is not specifically limited, the adhesive width of the first hair layer is preferably 5.0 mm or more and 11.0 mm or less. The adhesive width of the first hair layer of less than 5.0 mm is not preferred because an adhesive strength with the double-sided adhesive tape is insufficient, and meanwhile, the adhesive width of the first hair layer exceeding 11.0 mm is not preferred because it causes the move of the hairs constituting the first hair layer to be unnatural, and the attachment of the extension becomes easy to be noticed by other people.

While the adhesive width of the second hair layer is also not specifically limited, the adhesive width of the second hair layer is preferably 1.5 mm or more and 6.0 mm or less. The adhesive width of the second hair layer of less than 1.5 mm is not preferred because the hairs constituting the second hair layer become easy to fall out during the use, and meanwhile, the adhesive width of the second hair layer exceeding 6.0 mm is not preferred because the bonding portion of the second hair layer becomes noticeable and the attachment of the extension becomes easy to be noticed by other people.

In the hair extension according to the present invention, the first hair layer and the second hair layer are preferably formed to have approximately constant thicknesses, and it is more preferable that the thicknesses of the first hair layer and the second hair layer are each adjusted to 0.05 mm or more and 0.4 mm or less. The thickness of the first hair layer of less than 0.05 mm is not preferred because the double-sided adhesive tape becomes easy to be seen from outside, and meanwhile, the thickness of the first hair layer exceeding 0.4 mm is not preferred because the flexibility in folding of the hair extension is reduced. The thickness of the second hair layer of less than 0.05 mm is not preferred because the first hair layer becomes easy to be seen from outside and the attachment of the extension becomes easy to be noticed by other people, and meanwhile, the thickness of the second hair layer exceeding 0.4 mm is not preferred because the hairs (second hairs) constituting the second hair layer become easy to fall out. In addition, the thickness of the second hair layer equal to or less than the thickness of the first hair layer is more preferable because the adhesive strength of the second hair layer to the first hair layer increases.

In addition, the adhesive for bonding the base end of the hair bundle (that is, adhesive for forming the first hair layer and the second hair layer) is not specifically limited, and various kinds of resin-based adhesives (one dissolved in a solvent, one dispersed in water, and the like), such as acrylic resin-based, epoxy resin-based, polyurethane-based, polyolefin-based, ethylene-vinyl acetate resin emulsion-based, and silicone-based, can be appropriately used. Among them, using a polyurethane-based adhesive is preferable because the handling property during manufacture is improved, and the adhesive strengths of the respective first hair layer and second hair layer and the adhesive strength of an interface between the first hair layer and the second hair layer are improved. In the manufacture of the extension according to the present invention, while the adhesive for forming the first hair layer can be different from the adhesive for forming the second hair layer, the adhesive for forming the first hair layer the same as the adhesive for forming the second hair layer is more preferable because the adhesive strength between the first hair layer and the second hair layer is easily improved.

EMBODIMENTS

While the following describes the hair extension according to the present invention in detail with embodiments, the present invention is not limited to aspects of the embodiments, and can be changed as necessary without departing from the gist of the present invention.

<Structure of Hair Extension>

FIG. 1 illustrates the hair extension according to the present invention, and a hair extension 1 includes a hair bundle (collective body) 2, a double-sided adhesive tape 3, and a release paper (peeling paper) 4.

The hair bundle (collective body) 2 is formed by aligning base end portions (portions in opposite sides of hair end sides) of hairs (first hairs (human hairs) $h_1$, $h_1$ . . . and second hairs (human hairs) $h_2$, $h_2$ . . . ) in parallel and bundling the base end portions of the hairs. Then, the base end portion has a two-layer structure in which a second hair layer $L_2$ is laminated on an upper side of a first hair layer $L_1$. In the present invention, the first hair $h_1$ and the second hair $h_2$ may be referred to respectively as a first hair bundle and a second hair bundle. Also, the first hair layer $L_1$ and the second hair layer $L_2$ may be referred to respectively as a first base and a second base.

The first hair layer $L_1$ is formed by bonding the base ends of the bundled hairs $h_1$, $h_1$ . . . with an adhesive (containing a polyurethane-based resin as a main component) B, and has a size of right-left (right and left in FIG. 1) width×up-down (up and down in FIG. 1) length×thickness=22.0 mm×8.0 mm×0.2 mm.

While the second hair layer $L_2$ is formed by bonding the base ends of the bundled hairs $h_2$, $h_2$ . . . with the adhesive B the same as the adhesive B of the first hair layer $L_1$ similarly to the first hair layer $L_1$, an up-down (up and down in FIG. 1) length is shorter than that of the first hair layer $L_1$. That is, the second hair layer $L_2$ has a size of right-left (right and left in FIG. 1) width×up-down (up and down in FIG. 1) length×thickness=22.0 mm×3.5 mm×0.2 mm. Then, the first hair layer $L_1$ and the second hair layer $L_2$ are in a state of mutually bonded with the adhesive constituting the second hair layer $L_2$ in a state where base end edges are linearly aligned.

Furthermore, as described above, the double-sided adhesive tape 3 is stuck to a back side of the hair bundle 2 formed by laminating the second hair layer $L_2$ on the upper side of the first hair layer $L_1$. The double-sided adhesive tape 3 is one in which a gluing agent made of synthetic resin (acrylic-based resin) with an adherence property is laminated on both surfaces of a film (colored in black) made of synthetic resin (polyester) having a thickness of about 50 μm, and adhesive layers on both surfaces have a thickness of about 25 μm. The double-sided adhesive tape 3 has right-left (right and left in FIG. 1) width×up-down (up and down in FIG. 1) length approximately the same as that of the first hair layer $L_1$ of the hair bundle 2. Then, a surface in a back side (opposite side of the side in which the second hair layer $L_2$ is laminated) of the first hair layer $L_1$ of the hair bundle 2 is adhered to the gluing agent layer of one surface (front surface) of the double-sided adhesive tape 3, and the release paper (peeling paper) 4 having the same size as the double-sided adhesive tape 3 is adhered to the gluing agent layer of the other surface (back surface) of the double-sided adhesive tape 3. The release paper 4 has a thickness of about 0.1 mm.

Additionally, three inverted triangular-shaped cutouts (notches) 5, 5 . . . are formed at an outer end edge (end edge in an outer side in the longitudinal direction of the hair, end edge in the upper side in FIG. 1) of the double-sided adhesive tape 3, and a portion in a vicinity of an upper end edge of the double-sided adhesive tape 3 is divided into equal quarters by the cutouts 5, 5 . . . . The first hair layer $L_1$ and the second hair layer $L_2$ of the hair bundle 2 are also cut out in inverted triangular shapes together with the cutouts 5, 5 . . . . Each of the cutouts 5, 5 . . . has a size of width×depth (up-down height)=2.0 mm×1.0 mm. Furthermore, slits 6, 6 . . . having lengths of about 2.0 mm are formed downward (vertically) from the respective cutouts 5, 5 . . . .

<Method for Manufacturing Hair Extension>

Figure 3:
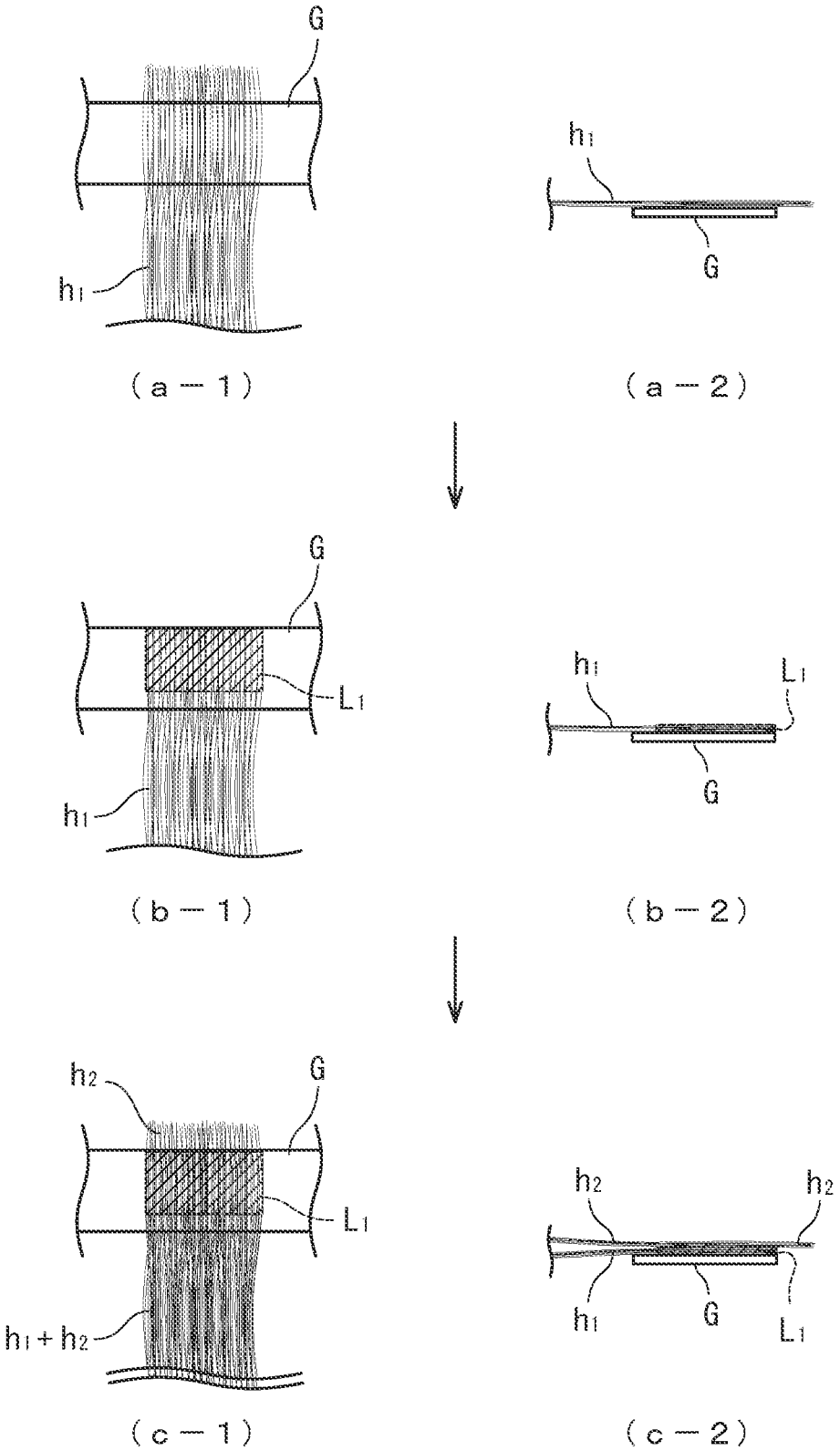
FIG. 3 is an explanatory drawing illustrating a method for manufacturing the hair extension (a-1 to c-1 are front views, and a-2 to c-2 are right side views).
Figure 4:
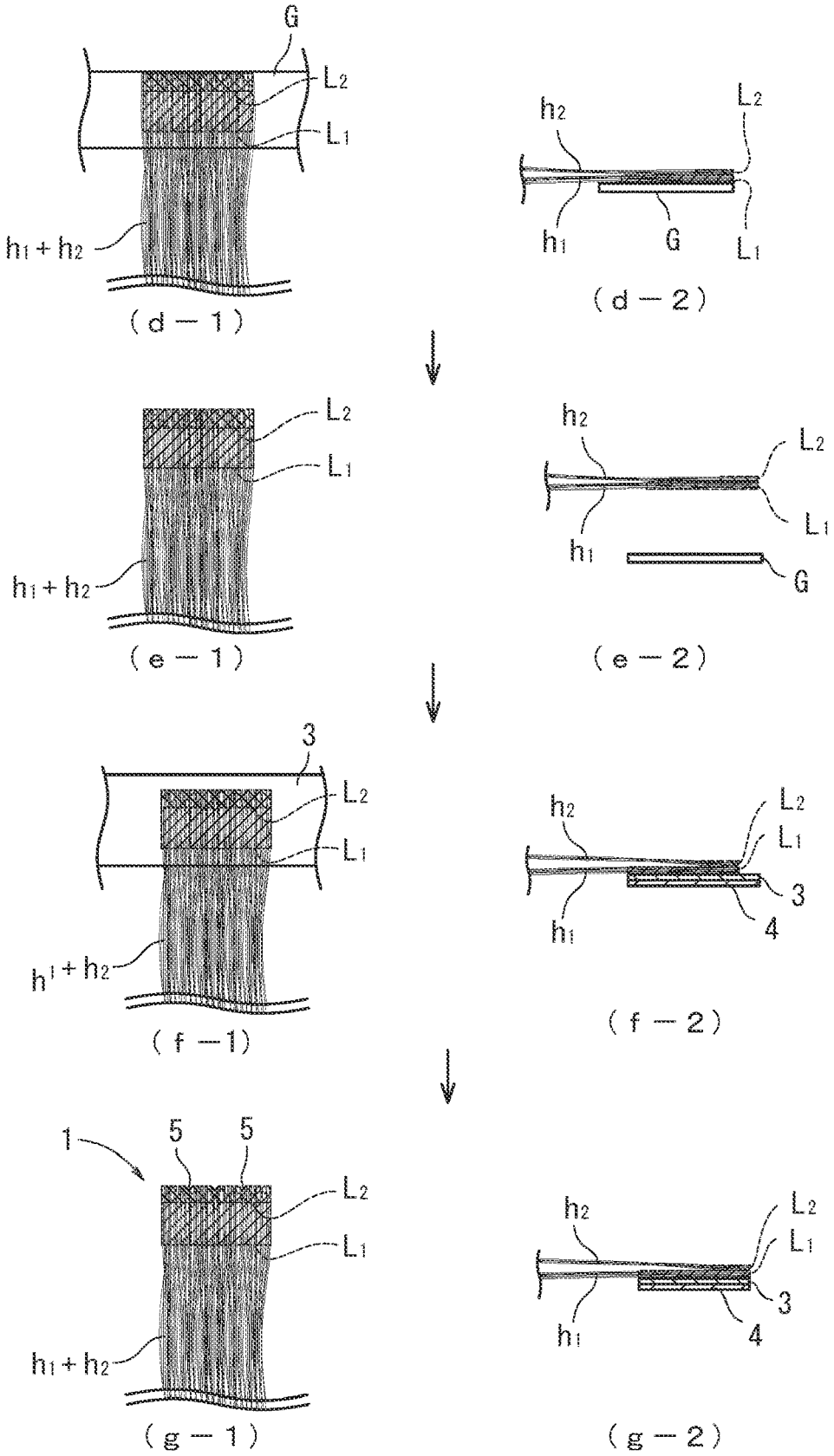
FIG. 4 is an explanatory drawing illustrating a method for manufacturing the hair extension (d-1 to g-1 are front views, and d-2 to g-2 are right side views).

FIG. 3 and FIG. 4 illustrate an exemplary method for manufacturing the hair extension 1 configured as described above. In manufacturing the hair extension 1, first, as illustrated in FIG. 3(*a*-1), FIG. 3(*a*-2), the bundled first hairs $h_1$, $h_1$ . . . (directions of ends of hairs are matched) are arranged to be parallel, and a portion in the vicinity of the base end is placed on a glass plate G used as a tool.

Next, as illustrated in FIG. 3(*b*-1), FIG. 3(*b*-2), the base end portion of the bundle of the first hairs $h_1$, $h_1$ . . . placed on the glass plate G is impregnated with a liquid adhesive (containing a polyurethane-based resin as a main component) with a constant width (constant width along the longitudinal direction of the hair). Furthermore, the portion impregnated with the adhesive as described above is sufficiently squeezed using a plate-shaped tool to remove the unnecessary adhesive, and the base end portion of the bundle of the first hairs $h_1$, $h_1$ . . . impregnated with the adhesive is adjusted so as to have the constant thickness. Subsequently, the bundle of the first hairs $h_1$, $h_1$ . . . in which the base end is impregnated with the adhesive as described above is heated at a predetermined temperature (about 60° C.) together with the glass plate G by a heating device (not illustrated) to dry and harden the adhesive, thereby forming the first hair layer $L_1$ at the base end of the bundle of the first hairs $h_1$, $h_1$ . . . . Furthermore, the base end sides of the first hairs $h_1$, $h_1$ . . . are linearly cut along an end edge of the glass plate G.

Further, as illustrated in FIG. 3(*c*-1), FIG. 3(*c*-2), the bundled second hairs $h_2$, $h_2$ . . . (directions of ends of hairs are matched) are arranged to be parallel on the base end portion (first hair layer $L_1$) of the first hairs $h_1$, $h_1$ . . . placed on the glass plate G, and a portion in a vicinity of the base end is placed on the glass plate G (that is, the bundle of the second hairs $h_2$, $h_2$ . . . is laminated on the first hair layer $L_1$).

Next, as illustrated in FIG. 4(*d*-1), FIG. 4(*d*-2), the base end portion of the bundle of the second hairs $h_2$, $h_2$ . . . placed on the glass plate G is impregnated with a liquid adhesive (containing a polyurethane-based resin as a main component) with a constant width (constant width along the longitudinal direction of the hair). When the base end portion of the bundle of the second the hairs $h_2$, $h_2$ . . . is impregnated with the liquid adhesive as described above, a width impregnated with the adhesive (width along the longitudinal direction of the hair) is adjusted to be shorter than the adhesive width of the first hair layer $L_1$.

Furthermore, the portion impregnated with the adhesive as described above is sufficiently squeezed using a plate-shaped tool to remove the unnecessary adhesive, and the base end portion of the bundle of the second hairs $h_2$, $h_2$ . . . impregnated with the adhesive is adjusted so as to have the constant thickness. Subsequently, the bundles of the first hairs $h_1$, $h_1$ . . . and the second hairs $h_2$, $h_2$ . . . are heated at a predetermined temperature (about 60° C.) together with the glass plate G by a heating device (not illustrated) to dry and harden the adhesive, thereby forming (laminating) the second hair layer $L_2$ including the bundle of the second hairs $h_2$, $h_2$ . . . on the first hair layer $L_1$. Furthermore, the base end sides of the second hairs $h_2$, $h_2$ . . . are linearly cut along the end edge of the glass plate G (that is, the base end edge of the first hair layer $L_1$ and the base end edge of the second hair layer $L_2$ are matched).

Subsequently, as illustrated in FIG. 4(*e*-1), FIG. 4(*e*-2), the glass plate G attached to the back surface of the first hair layer $L_1$ is removed. Further, as illustrated in FIG. 4(*f*-1), FIG. 4(*f*-2), an adhesive surface of the double-sided adhesive tape 3 is adhered to the back surface of the first hair layer $L_1$ from which the glass plate G has been removed. When the adhesive surface of the double-sided adhesive tape 3 is adhered to the back surface of the first hair layer $L_1$ as described above, the adjustment is performed to match the end edge in the inner side of the first hair layer $L_1$ and the end edge in the inner side of the double-sided adhesive tape. Further, as illustrated in FIG. 4(*g*-1), FIG. 4(*g*-2), inverted triangular-shaped cutouts (notches) 5, 5 . . . and slits 6, 6 . . . are formed (cut by pressing a shaped blade against the hair bundle 2) at the base end of the hair bundle 2, in which the double-sided adhesive tape 3 is adhered to the back surface of the first hair layer $L_1$, including the first hairs $h_1$, $h_1$ . . . and the second hairs $h_2$, $h_2$ . . . , thereby completing the manufacture of the extension 1.

<Method for Using Hair Extension>

Figure 5:
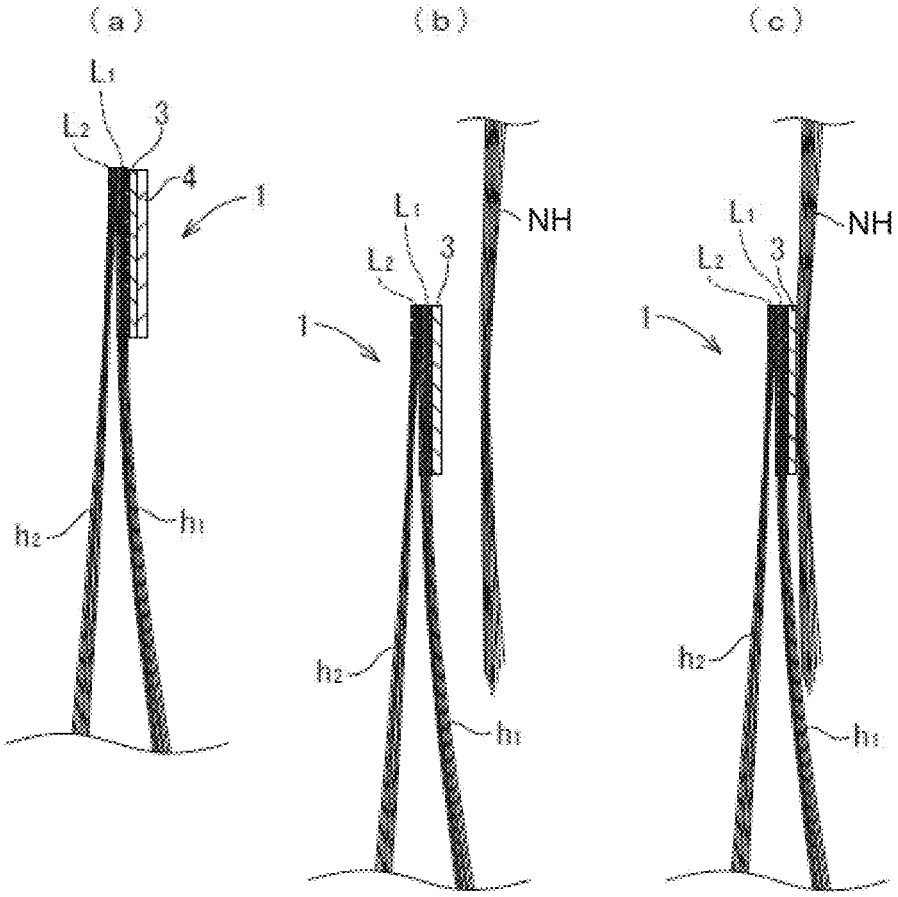
FIG. 5 is an explanatory drawing (side view) illustrating a state of attaching the hair extension to head hair (natural hair) (a illustrates a state before attaching, b illustrates a state where a release paper is removed, and c illustrates a state of being adhered to natural hair).
Figure 6:
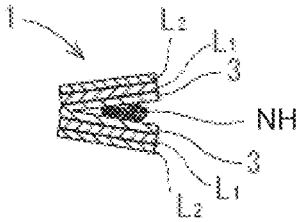
FIG. 6 is an explanatory drawing illustrating a state of attaching the hair extension to the head hair (natural hair) (plan view in a state where the release paper is removed).
Figure 7:
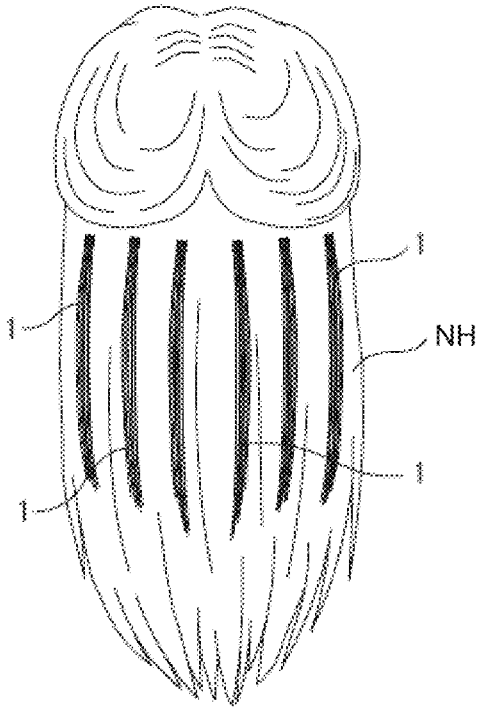
FIG. 7 is an explanatory drawing (drawing of head hair viewed from above) illustrating a state where the hair extension is attached to the head hair (natural hair).

FIG. 5 to FIG. 7 illustrate the method for attaching the hair extension 1 to the head hair (natural hair), and when the hair extension 1 is attached to the head hair, for example, by lifting the surface natural hairs (ones growing from near the top of the head) upward, the inner natural hairs (ones growing from the middle in the height position of the head) are exposed. Then, as illustrated in FIG. 5(*b*), the release paper 4 of the hair extension 1 is removed to expose the adhesive surface (adhesive layer) of the double-sided adhesive tape 3. Subsequently, as illustrated in FIG. 5(*c*), the adhesive surface of the double-sided adhesive tape 3 is adhered to a natural hair bundle (bundle of the inner natural hairs) NH, thus attaching the hair extension 1. Since the cutouts 5, 5 . . . are formed at the upper end edge of the double-sided adhesive tape 3, and the slits 6, 6 . . . are provided downward the respective cutouts 5, 5 . . . , the extension 1 can be attached by sandwiching the natural hair bundle G with the double-sided adhesive tape 3 folded in two such that the adhesive surfaces in the outer side of the two face each other at the positions at which the cutouts 5, 5 . . . and the slits 6, 6 . . . are provided as illustrated in FIG. 6.

Then, the desired number of hair extensions 1, 1 . . . are adhered to the natural hair bundles NH at approximately the same height position of the head hair along a lateral direction (width direction) at regular intervals by the above-described method (see FIG. 7). Subsequently, the surface natural hairs in the lifted state are drooped back.

In the hair extension 1 attached to the natural hair as described above, since the second hair layer $L_2$ having the adhesive width narrower than that of the first hair layer $L_1$ is laminated on the upper side of the first hair layer $L_1$ positioned in the outer side (front surface side) of the double-sided adhesive tape 3 (that is, since the first hair layer $L_1$ is covered with the second hair layer $L_2$ in which the bonding portion is less likely to be noticeable), the double-sided adhesive tape 3 is hardly seen from outside. Therefore, it is not recognizable at all for other people that the hair extensions 1, 1 . . . are attached to the head hair.

<Effect of Hair Extension>

As described above, the hair extension 1 includes the hair bundle 2 having the base end including the first hair layer $L_1$ formed by laterally aligning the plurality of hairs $h_1$, $h_1$ . . . such that base end edges are linearly arranged and bonding the vicinities of the base ends of the hairs $h_1$, $h_1$ . . . with an adhesive so as to have the constant adhesive width, and the second hair layer $L_2$ formed by laminating the plurality of hairs $h_2$, $h_2$ . . . to be laterally aligned on the upper side of the first hair layer $L_1$ such that base end edges are linearly arranged and bonding the vicinities of the base ends of the hairs $h_2$, $h_2$ . . . with an adhesive so as to have the adhesive width narrower than the adhesive width of the first hair layer $L_1$. The double-sided adhesive tape (adhering means) 3 is stuck to the first hair layer $L_1$.

Accordingly, the hair extension 1 can be very easily attached to the head hair in a very short period using the double-sided adhesive tape 3, and in addition, since the double-sided adhesive tape 3 is less likely to be seen from the outside of the base end of the hair bundle 2, its attachment is less likely to be noticed by other people. Additionally, the case where the natural hair is bonded to the double-sided adhesive tape 3 from the gap in the adhered hair as the conventional hair extension does not occur at all. In the hair extension 1, since the double-sided adhesive tape 3 has the same color (black) as the first hairs $h_1$, $h_1$ . . . and the second hairs $h_2$, $h_2$ . . . , and it is extremely difficult to recognize the double-sided adhesive tape 3 from outside, its attachment is much less likely to be noticed by other people.

Furthermore, in the hair extension 1, since the first hair layer $L_1$ and the second hair layer $L_2$ are formed to have the constant thicknesses, the double-sided adhesive tape 3 is extremely less likely to be seen from the outside of the base end of the hair bundle 2, and additionally, since the adhesive strength between the first hair layer $L_1$ and the second hair layer $L_2$ is high, a case where the bundled hairs (mainly the second hairs $h_2$, $h_2$ . . . ) fall out is less likely to occur.

In the hair extension 1, since the thicknesses of the first hair layer $L_1$ and the second hair layer $L_2$ are each adjusted to 0.2 mm, and the thickness of the second hair layer $L_2$ is the same as the thickness of the first hair layer $L_1$, the double-sided adhesive tape 3 is extremely less likely to be seen from the outside of the base end of the hair bundle 2, and additionally, a case where the second hair layer $L_2$ falls out is less likely to occur even in a case of use for a long period of time.

In addition, since the hair extension 1 is provided with the slits 6, 6 . . . in parallel at predetermined intervals at the outer end edge of the double-sided adhesive tape 3, the hair extension 1 can be strongly bonded (adhered) in a state where the double-sided adhesive tape 3 is folded at the portions of the slits 6, 6 . . . and the head hair (natural hair) is sandwiched by the double-sided adhesive tape 3.

<Modifications of Hair Extension>

The hair extension according to the present invention is not limited to the aspects of the above-described embodiment, and the configurations such as the material, the shape, the structure, and the size of the hair bundle, the double-sided adhesive tape, and the release paper can be appropriately changed as necessary without departing from the gist of the present invention.

For example, the hair extension according to the present invention is not limited to one that uses only human hairs as the hairs as the above-described embodiment, and can be changed to, for example, one that uses artificial hairs as at least a part of the hairs.

The hair extension according to the present invention is not limited to one that includes the double-sided adhesive tape with the base material of the synthetic-resin film as the above-described embodiment, and the base material of the double-sided adhesive tape can be changed to paper or the like. When the base material of the double-sided adhesive tape is the synthetic-resin film as the above-described embodiment, there is a merit that the double-sided adhesive tape is less likely to tear in washing the hair in the attached state.

Furthermore, the hair extension according to the present invention is not limited to one in which the double-sided adhesive tape is black as the above-described embodiment, and the double-sided adhesive tape may be colored in a color other than black, or need not to be colored. For example, when the hair extension according to the present invention is attached to the natural hair of brown or gold, the hair extension that includes the first hair, the second hair, and the double-sided adhesive tape of brown or gold can be used according to the color of the natural hair.

Furthermore, the hair extension according to the present invention is not limited to one in which the gluing agent of the double-sided adhesive tape is the gluing agent made of acrylic-based resin as the above-described embodiment, and the gluing agent can be changed to a rubber-based gluing agent or a gluing agent made of resin other than acrylic-based resin, such as a gluing agent made of silicone-based resin. When the gluing agent of the double-sided adhesive tape is the gluing agent made of acrylic-based resin as the above-described embodiment, there is a merit that the adhesive capacity is less likely to decrease even when the hair is washed using a surfactant (shampoo and the like) in the attached state (that is, the first hair bundle and the second hair bundle are less likely to be removed, and less likely to come off the natural hair).

Furthermore, the hair extension according to the present invention is not limited to one in which the base end of the hair bundle includes only the first hair layer and the second hair layer as the above-described embodiment, and for example, a third hair layer having an adhesive width further narrower (shorter) than the adhesive width (adhesive width along the longitudinal direction of the hair) of the second hair layer may be laminated on the upper side of the second hair layer.

In addition, the aspect of attaching a plurality of hair extensions is not limited to the aspect of attaching at approximately the same height position of the head hair along the lateral direction (width direction) at regular intervals as the above-described embodiment, and can be changed as necessary according to the volume of the natural hair and the desired hairstyle.

Meanwhile, the method for manufacturing the hair extension according to the present invention is not limited to one in which the first hair layer and the second hair layer are formed at the base end of the hair bundle having the predetermined lateral width (lateral width of one piece) and the double-sided adhesive tape is attached as the above-described embodiment, and can be changed to, for example, one in which the first hair layer and the second hair layer are formed at a base end of a wide hair bundle (having a lateral width of two pieces or more) and the double-sided adhesive tape is attached, and subsequently, cutting is performed so as to have a predetermined lateral width (lateral width of one piece).

INDUSTRIAL APPLICABILITY

Since the hair extension of the present invention provides the excellent effects as described above, the hair extension can be appropriately used as a member to increase the volume of natural hair.

DESCRIPTION OF REFERENCE SIGNS

1 . . . Hair extension
2 . . . Hair bundle (collective body)
3 . . . Double-sided adhesive tape (adhering means
4 . . . Release paper (peeling paper)
5 . . . Cutout
6 . . . Slit
h . . . First hair
$h_2$ . . . Second hair
$L_1$ . . . First hair layer
$L_2$ . . . Second hair layer
NH . . . Natural hair bundle
B . . . Adhesive

The invention claimed is:

1. A hair extension comprising:

a hair bundle composed with a first hair bundle and a second hair bundle that are a plurality of hairs, a base end that is fixed to a proximal end of the hair bundle; and a double-sided adhesive tape that is stuck to the base end and is configured to attach the hair bundle to natural hairs of a user, wherein the base end of the hair bundle includes:

a first base that is a mass of cured resin and has a thin layer shape such that a proximal end of the first hair bundle is retained inside the first base and the hairs of the first hair bundle extend from the first base in a vertical direction and align in a horizontal direction, which is perpendicular to the vertical direction, wherein the first base has a predetermined length in the vertical direction and a predetermined thickness in a thickness direction, which is perpendicular to both the vertical direction and the horizontal direction, and the first base has two surfaces facing in opposite directions to each other, and the double-sided adhesive tape is attached to one of the surfaces of the first base, a second base that is a mass of cured resin and has a thin layer shape such that a proximal end of the second hair bundle is retained inside the second base, and the hairs of the second hair bundle extend from the second base in the vertical direction and align in the horizontal direction wherein the second base has a predetermined length in the vertical direction and a predetermined thickness in the thickness direction, wherein the second base is placed on the other of the surfaces of the first base, which is opposite from the double-sided adhesive tape, the first base and the second base are both made of polyurethane-based resin, the thicknesses of the first base and the second base are constant in the vertical direction and are each ranged from 0.05 mm to 0.4 mm, and the thickness of the second base is smaller than the thickness of the first base, the length of the second base is shorter than the length of the first base, and upper edges of the first base, the second base, and the double-sided adhesive tape in the vertical direction are aligned flush, forming an upper edge of the base end.

2. The hair extension according to claim 1, wherein cutouts are formed at the upper edge of the base end at predetermined intervals in the horizontal direction, and each of the cutouts has a slit that extends away from the upper edge of the base end in the vertical direction such that the slits are arranged in parallel at predetermined intervals in the horizontal direction.

3. The hair extension according to claim 2, wherein the double-sided adhesive tape is formed of polyester-based resin, each of the cutouts has an isosceles triangle shape of which a base is located at the upper edge of the base end and an apex is directed away from the upper edge of the base end in the vertical direction, the slit that corresponds to each of the cutouts extends from the apex of the triangle shape, and a width of the base of the triangle shape in the horizontal direction is approximately the same as a length of the slits in the vertical direction.

4. The hair extension according to claim 3, wherein each of the cutouts has a triangle shape.

5. The hair extension according to claim 4, wherein the thicknesses of the first base and the second base are each ranged from 0.2 mm to 0.4 mm.

6. The hair extension according to claim 4, wherein the proximal end of the first hair bundle is located at the upper edge of the first base, and the first hair bundle penetrates the first base in the vertical direction, and the proximal end of the second hair bundle is located at the upper edge of the second base, and the second hair bundle penetrates the second base in the vertical direction.

7. The hair extension according to claim 3, wherein the thicknesses of the first base and the second base are each ranged from 0.2 mm to 0.4 mm.

8. The hair extension according to claim 7, wherein the proximal end of the first hair bundle is located at the upper edge of the first base, and the first hair bundle penetrates the first base in the vertical direction, and the proximal end of the second hair bundle is located at the upper edge of the second base, and the second hair bundle penetrates the second base in the vertical direction.

9. The hair extension according to claim 3, wherein the proximal end of the first hair bundle is located at the upper edge of the first base, and the first hair bundle penetrates the first base in the vertical direction, and the proximal end of the second hair bundle is located at the upper edge of the second base, and the second hair bundle penetrates the second base in the vertical direction.

10. The hair extension according to claim 1, wherein the proximal end of the first hair bundle is located at the upper edge of the first base, and the first hair bundle penetrates the first base in the vertical direction, and the proximal end of the second hair bundle is located at the upper edge of the second base, and the second hair bundle penetrates the second base in the vertical direction.

* * * * *